US005592874A

United States Patent [19]

Blauhut

[11] Patent Number: 5,592,874

[45] Date of Patent: Jan. 14, 1997

[54] DOUBLE BELT PRESS WITH HYDROSTATIC BELT SUPPORT

[75] Inventor: Wilfried Blauhut, Linz, Austria

[73] Assignee: PCD Polymere Gesellschaft m.b.H., Schwechet-Mannsworth, Austria

[21] Appl. No.: 305,610

[22] Filed: Sep. 14, 1994

[30] Foreign Application Priority Data

Sep. 14, 1993 [AT] Austria ..... A 1850/93

[51] Int. Cl.[6] ..... B30B 5/06

[52] U.S. Cl. ..... 100/93 RP; 100/154; 156/583.5; 425/371

[58] Field of Search ..... 100/93 P, 151–154, 100/93 RP; 156/583.5; 425/371

[56] References Cited

U.S. PATENT DOCUMENTS

| | | | |
|---|---|---|---|
| 3,748,225 | 7/1973 | Busker et al. | 100/154 |
| 4,365,548 | 12/1982 | Pankoke | 100/154 |
| 4,384,516 | 5/1983 | Pankoke | 156/583.5 |
| 4,541,889 | 9/1985 | Held | 100/154 |
| 4,555,988 | 12/1985 | Pankoke | 156/583.5 |
| 4,665,819 | 5/1987 | de Brock | 100/154 |
| 4,714,015 | 12/1987 | Stäbler | 100/154 |
| 4,723,484 | 2/1988 | Held | 100/93 P |
| 4,921,569 | 5/1990 | Held | 100/151 |
| 5,272,967 | 12/1993 | Held | 100/93 P |
| 5,352,321 | 10/1994 | Held | 100/154 |

FOREIGN PATENT DOCUMENTS

| | | |
|---|---|---|
| 977263 | 11/1975 | Canada . |
| 0295427 | 11/1991 | European Pat. Off. . |
| 0544645 | 6/1993 | European Pat. Off. . |
| 2155547 | 5/1972 | Germany . |
| 2419706 | 11/1975 | Germany . |
| 2937972 | 4/1981 | Germany . |
| 3013231 | 10/1981 | Germany . |
| 3634273 | 4/1988 | Germany . |
| 3709958 | 10/1988 | Germany . |
| 4208263 | 9/1993 | Germany . |

OTHER PUBLICATIONS

Derwant WPI No. 88–113289/17 for DE 3634273.
Derwant WPI No. 93–296168/38 for DE 4208263.
Derwant WPI No. N88–222994 for DE 3709958.
Derwant WPI No. 93–177394/22 for EP 544645.
Derwant WPI No. 92–218126/27 for DE 4041850.
Derwant WPI No. 93–296168/38 for DE 4208263.
Derwant WPI No. 93–296168/38 for DE 4208263.
Derwant WPI No. 81–60462D/34 for DE 3013231.

*Primary Examiner*—Stephen F. Gerrity
*Attorney, Agent, or Firm*—Wenderoth, Lind & Ponack

[57] ABSTRACT

A double belt press for the continuous manufacture of material webs. The press includes pressing belts which are supported by support strips mounted on pressing plates. The support strips form pressure chambers which receive fluid pressure media for acting on a surface of the pressing belt.

5 Claims, 1 Drawing Sheet

DOUBLE BELT PRESS WITH HYDROSTATIC BELT SUPPORT

BACKGROUND OF THE INVENTION

The invention relates to a double belt press with a hydrostatic belt support, in which the pressing belts are supported by support strips.

Continuous double belt presses are known from, for example, EP-A-544645. They are used in particular for the manufacture of webs or panels made of materials which are completely or partially free-flowing on passage through the double belt press. In particular plastics, such as e.g. thermoplastics or duromers passing through thermoplastic phases, which may possibly contain fillers or reinforcing fibers, are materials which may be used. It is also possible to have a reinforcing web running into the double belt press, onto which the materials are applied before running into the double belt press, for example, in the manufacture of thermoplastics reinforced with glass-fiber mats.

In general, the materials are supplied to the entrance point of the double belt press without pressure. A pressure is exerted on the material web only in the gap between the pressing belts. In isobaric presses, the pressure is exerted by a fluid pressure medium, such as e.g. hydraulic liquids or compressed air, in pressure chambers on the side of the pressing belts facing away from the material. In this case, pressure chambers are delimited by one side of the pressure plates, the respective pressing belt and annular seals between the pressure plate and the pressing belt. Consequently, the hydrostatic pressure of the pressure medium acts directly on the respective pressing belt which transmits this pressure as a diaphragm directly to the material web in the pressing gap, which web is in turn supported on the opposite pressing belt. The mutually opposite pressure chambers of both pressing belts must therefore be acting with the same pressure. Consequently, the material web begins the passage through the press without pressure, then passes into pressing zones of the respectively set pressures, and then leaves the press without pressure again.

If the material web in the double belt press is in a free-flowing state, it tends to flow according to the pressure gradient. This means that for the part of the press which, in the belt running direction, lies in front of the zone of a greater pressure, the free-flowing material would tend to flow back counter to the belt running direction. This can be counteracted only by viscosity forces. In the region of the pressure build-up there is a relative speed between the material and the pressing belts which is counter to the transport direction. Consequently, the pressure in the material is built up ensuring that a pressure already prevails before the respective pressure zone is reached. This is contradictory to the principle of the isobaric press, in which identical pressure is intended to prevail everywhere in a pressure zone. As a result of the premature pressure build-up, the pressing belts are forced against pressure chamber walls, seals or heat transmission bridges. This is particularly disadvantageous because the machine parts are not designed for sliding under high pressure and thus are subject to excessive wear.

To solve the above problem, it is proposed in EP-A-544, 645 to support the pressing belts with a roller bed. An areal force prevails on the material side but, on the support side, only a linear pressure is transmitted via the pressure lines between belt and support rollers. The Hertzian stress resulting from the contact lines limits the application of this principle. Both the belt surfaces and the support rollers are constantly varyingly stressed close to the limits of elasticity by the Hertzian stress in the contact lines, which immediately leads to fatigue phenomena particularly in the pressing belts. Moreover, the pressing belts are subject to great bending stresses as they run over the support rollers, which leads to increased wear of the pressing belts.

SUMMARY OF THE INVENTION

Consequently, the need arose to support the pressing belts in such a manner that the above-noted disadvantages attendant with support rollers are avoided. It was discovered that this aim could be achieved by supporting the pressing belts with flat support strips which are acted upon with fluid pressure media.

The subject of the invention is a double belt press for the continuous manufacture of material webs. During manufacture of the webs, the material used in forming the webs passes between Pressure is applied to the respective belt inner surfaces by fluid pressure chambers. The pressure chambers are formed by pressure plates, belt support strips mounted on the pressure plates, and at least one annular sliding surface seal. A fluid pressure media can be introduced into the pressure chambers to generate a surface pressure on the belts.

A pressure zone is established between the opposing belt surfaces. In the pressure zone, associated with each pair of pressure plates, a pressure chamber is established, characterized in that the pressure in a pressure chamber is less than the pressure in subsequent chambers in the direction of belt travel. Also, the belt support strips form additional support pressure chambers which are acted on by the same fluid pressure medium in the pressure chamber in which they are arranged.

BRIEF DESCRIPTION OF THE DRAWINGS

Other features and objects of the invention will become apparent from the following details description in conjunction with the accompanying drawings, which illustrate, by way of example, the features of the invention.

DETAILED DESCRIPTION OF THE INVENTION

Figure 1:
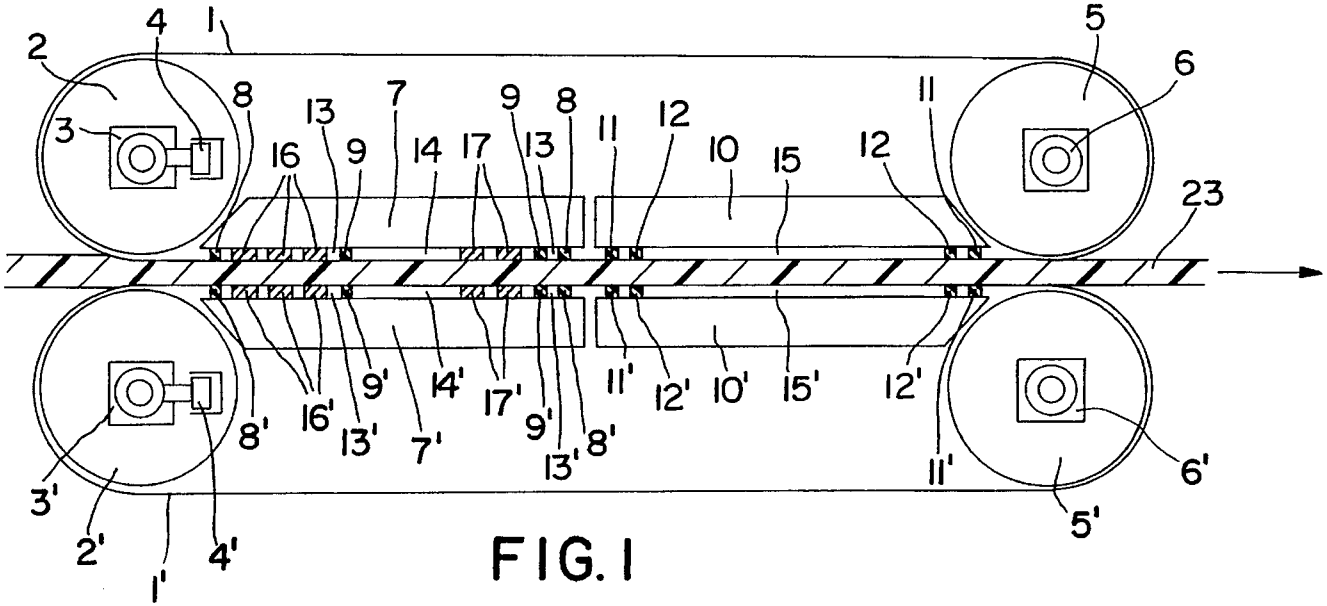
FIG. 1 is a cross-sectional side view of an embodiment of the present invention.

The subject of the invention is a double belt press for the continuous manufacture of material webs (23). During the manufacture of the webs, the material passes through a free-flowing state. The double belt press includes a press frame, in which deflection drums (2, 2', 5, 5') are rotatably mounted. An upper and a lower endless pressing belt (1, 1') are supported on the deflection drums, and define a pressing zone, in which the material web is guided and pressed under a surface pressure. The pressing zone is formed between mutually opposing outer sides of the pressing belts (1, 1'). Pressure chambers (14, 14', 15, 15') are formed which act on the inner sides of the perspective belt. The pressure chambers are delimited in the vertical direction by pressure plates (7, 7', 10, 10') which are fastened in the press frame and by the inner sides of the pressing belts (1, 1'). The chambers are also delimited in the horizontal direction by inner sliding-surface seals (9, 9', 12, 12') and possibly an outer (8, 8', 11, 11') sliding-surface seals, which are annularly self-contained and between which an annular space (13, 13') is formed. Also, the chambers can be acted upon with fluid pressure media for generating the surface pressure on the pressing belts. The first pressure chambers, in the running direction of the belt, are operated at a lower pressure than the following pressure chambers. Also, belt support strips (16, 16') may be arranged in a side of the annular space (13, 13') facing the press entrance in front of the first pressure chamber relative to the running direction of the pressing belts The belt support strips (16, 16', 17, 17') are supported on the pressure plate and form additional support pressure chambers (20') with a surface (18') facing the belt, projecting side delimitations (19') extending from this surface and the belt. The chambers (20') are acted upon with a constant mass flow of the same fluid pressure medium as the pressure chamber in or in front of which they are arranged.

The support strips extend over the entire width of the pressing belt. The number of support strips and their width in the belt running direction are selected in such a manner that the entire zone of the retracting product pressure is supported. The specific number of strips is dependent upon the product type and upon the respective operating conditions, in particular the transport speed of the pressing belts.

The mass flow of the pressure medium is set pressure-independently in such a manner that a constant flow of the pressure medium takes place from the support pressure chamber (20), between the pressing belt (1) and the side delimitation (19), into the surrounding pressure chamber (14) or into the surrounding annular space (13). As a result, the pressing belts slide with only low friction on the fluid pressure medium and not on rigid elements. The pressure medium overflowing into the annular space (13) can, for example, be drawn off and guided back into the pressure medium circuit. A gap between pressing belt (1) and side delimitation (19), arises as a result of the pressing belt (1) lifting off during overflowing of the fluid introduced into the support pressure chambers. The size of the gap is in the order of magnitude of approximately a few hundredths of a millimeter.

The support strips are also preferably designed as heat-transmission strips, which allows heating or cooling of the material web via the pressing belts. To this end, the support strips preferably contain either bores with electric heating elements, such as e.g. heating bars, or ducts, through which a heat-transfer medium flows.

An arrangement of the support strips according to the invention in a double belt press having two pairs of pressure plates arranged one behind the other in the running direction is illustrated by way of example in FIG. 1. The working or running direction is indicated by the arrow. The press is operated in such a manner that a greater fluid pressure prevails in the pressure chambers (15, 15') of the second pair of pressure plates (10, 10') than in the pressure chambers (14, 14') of the first pair of pressure plates (7, 7').

The press of FIG. 1, illustrates the upper pressing belt (1), the lower pressing belt (1'), upper and lower entrance-side deflection drums (2, 2'), the drums respective bearings (3, 3'), a belt tensioning arrangement (4, 4'), the exit-side deflection drums (5, 5'), and the exit-side drum bearings (6, 6'). The first pair of pressure plates (7, 7') support the outer of the two annular seals (8, 8') of the first pair of pressure plates and the corresponding inner seals (9, 9'). The second pair of pressure plates (10, 10') support the outer of the two annular seals (11, 11') of the second pair of pressure plates (10, 10') and the corresponding inner seals (12, 12'). The annular spaces are formed between the inner and outer seals (13, 13'), the pressure plates and the pressing belt. The pressure chambers (14, 14') are associated with the first pair of pressure plates. The pressure chambers (15, 15') are associated with the second pair of pressure plates. The support strips (16, 16') are provided in the entrance-side part of the first annular spaces (13, 13'), and support strips (17, 17') are provided on the side of the pressure chambers (14, 14') adjacent the second pair of pressing plates (10, 10').

Figure 2:
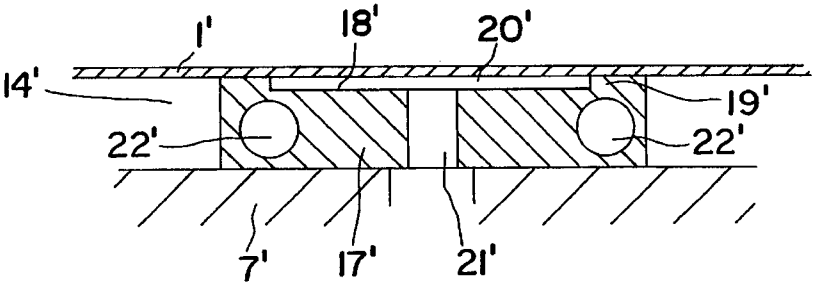
FIG. 2 is a cross-sectional view of a lower support strip.

FIG. 2 shows a cross-section through the lower support strip 17'. Illustrated in FIG. 2 are the lower pressing belt (1'), the lower first pressure plate (7'), the pressure chamber (14'), the surface (18') of the support strip facing the pressing belt 1', the side delimitation (19') projecting from surface (18'), the support pressure chamber (20') of the belt support strip (17'), which is delimited by the pressing belt (1'), the surface (18') and the side projections (19'), the supply duct for the pressure medium (21') and the ducts (22') for accommodating heating elements or fluid heat-transfer media.

What I claim is:

1. A double belt press comprising:

a rigid press frame;

a first pair of drums rotatively mounted in said frame;

an upper endless pressing belt positioned on said first pair of drums and having an inner surface and an outer pressing surface;

a second pair of drums rotatively mounted in said frame;

a lower endless pressing belt positioned on said second pair of drums and having an inner surface and an outer pressing surface;

a first upper pressure plate fixed in said frame between said first pair of drums;

a first lower pressure plate fixed in said frame between said second pair of drums and opposing said first upper pressure plate;

a first annular sliding-surface seal mounted on each of said first upper and lower pressure plates, said annular seals defining upper and lower pressure chambers;

a plurality of belt support strips mounted on each of said pressure plates and being circumscribed by said first annular seal, said support strips having an inner surface opposing said inner surface of said belt and extending across the width of said belt, each said strip including longitudinal side projections operatively engaging said inner surface of said respective belt, an inner surface extending between said side projections, and a fluid pressure supply duct extending through said support strip between said longitudinal side projections, wherein each support strip defines a support pressure chamber which is delimited by said inner surface of said respective belt, said longitudinal side projections, and said inner surface of said support strip; and a second annular sliding-surface seal mounted on each of said pressure plates and spaced from said first annular sliding-surface seal, respectively, said first and second annular seals defining an annular space therebetween, wherein at least one of said plurality of support strips are located in said annular space on an entrance side of said annular space relative to the direction of travel of said belts.

2. The double belt press as claimed in claim 1, wherein said support strips include means for transmitting heat to said belts.

3. The double belt press as claimed in claim 1, further comprising electric heating bars embedded in said support strips.

4. The double belt press as claimed in claim 1, wherein said support strips include internal ducts for circulating a heat-transfer fluid therethrough.

5. A double belt press comprising:

a rigid press frame;

a first pair of drums rotatively mounted in said frame;

an upper endless pressing belt positioned on said first pair of drums and having an inner surface and an outer pressing surface;

a second pair of drums rotatively mounted in said frame;

a lower endless pressing belt positioned on said second pair of drums and having an inner surface and an outer pressing surface;

a first upper pressure plate fixed in said frame between said first pair of drums;

a first lower pressure plate fixed in said frame between said second pair of drums and opposing said first upper pressure plate;

a first annular sliding-surface seal mounted on each of said first upper and lower pressure plates, said annular seals defining upper and lower pressure chambers;

a plurality of belt support strips mounted on each of said pressure plates and being circumscribed by said first annular seal, said support strips having an inner surface opposing said inner surface of said belt and extending across the width of said belt, each said strip including longitudinal side projections operatively engaging said inner surface of said respective belt, an inner surface extending between said side projections, and a fluid pressure supply duct extending through said support strip between said longitudinal side projections, wherein each support strip defines a support pressure chamber which is delimited by said inner surface of said respective belt, said longitudinal side projections, and said inner surface of said support strip;

a second upper pressure plate fixed in said frame between said first pair of drums;

a second lower pressure plate fixed in said frame between said second pair of drums and opposing said first upper pressure plate;

a first annular sliding-surface seal mounted on each of said second upper and lower pressure plates; and a second annular sliding-surface seal mounted on each of said second upper and lower pressure plates, wherein said annular seals define an annular space therebetween.

* * * * *